US005150674A

United States Patent [19]

Gracyalny

[11] Patent Number: 5,150,674

[45] Date of Patent: Sep. 29, 1992

[54] CENTRIFUGALLY RESPONSIVE COMPRESSING RELEASE MECHANISM

[75] Inventor: Gary J. Gracyalny, Milwaukee, Wis.

[73] Assignee: Briggs & Stratton Corporation, Wauwatosa, Wis.

[21] Appl. No.: 703,616

[22] Filed: May 21, 1991

[51] Int. Cl.[5] ..... F01L 13/08

[52] U.S. Cl. ..... 123/182.1

[58] Field of Search ..... 123/182, 90.16

[56] References Cited

U.S. PATENT DOCUMENTS

| | | | |
|---|---|---|---|
| 3,314,408 | 4/1967 | Fenton | 123/182 |
| 3,362,390 | 1/1968 | Esty | 123/182 |
| 3,381,676 | 5/1968 | Campen | 123/182 |
| 3,395,689 | 8/1968 | Kruse | 123/182 |
| 3,496,922 | 2/1970 | Campen | 123/182 |
| 3,620,203 | 11/1971 | Harkness | 123/182 |
| 3,901,199 | 8/1975 | Smith | 123/182 |
| 4,453,507 | 6/1984 | Braun et al. | 123/182 |

*Primary Examiner*—Andrew M. Dolinar

*Attorney, Agent, or Firm*—Andrus, Sceales, Starke & Sawall

[57] ABSTRACT

An improved centrifugally responsive compression release mechanism transmits the valve loads from the valve operating means through the auxiliary cam member to a plurality of shoulders on the camshaft. The compression release member has a curved saddle to which is attached the auxiliary cam member as well as opposed, downwardly extending flyweights that are generally parallel to the longitudinal axis of the camshaft. The compression release member is pivotally connected to the camshaft by pair of pins extending from the camshaft outer surface and by pair of opposed pin retainers on the compression release member. Valve loads are transmitted through the compression release member to surfaces on the pin retainers which in turn abut the camshaft shoulders.

32 Claims, 2 Drawing Sheets

CENTRIFUGALLY RESPONSIVE COMPRESSING RELEASE MECHANISM

BACKGROUND OF THE INVENTION

This invention relates to an automatic compression relief mechanism for internal combustion engines, and more particularly to a centrifugally responsive compression release mechanism.

It is often desirable to reduce the amount of compression in a combustion chamber at engine cranking speeds to facilitate starting of the engine. In pull-starting engines, for example, reduced compression in the combustion chamber lessens the amount of operator effort in pulling the engine pull rope. The engine is easier to start, and operator fatigue is minimized.

In a conventional compression release mechanism, an auxiliary cam member engages a cam follower at engine cranking speeds to partially unseat either the intake valve or the exhaust valve to relieve compression in the combustion chamber. At higher engine speeds, the auxiliary cam member moves to an inoperative position so that it does not engage the cam follower and the valve is not unseated by the auxiliary cam member. At these higher engine running speeds, the valves are cyclically unseated by a cam affixed to a camshaft, which rotates in timed relation to the engine crankshaft.

It is apparent that the cam follower and the valve operating means impart a force or a load upon the auxiliary cam member. In some prior art compression release mechanisms, this load is borne by the pivot pins which pivotally connect the compression release member to the camshaft. Such devices have the disadvantage that the imparted loads tend to result in an excessive wear on the pivot pins as well as on the pivot pin retainer holes in the compression release mechanism. This excessive wear causes the compression release mechanism to become less effective or to fail all together. The pivot pins may even break off due to the imparted loads.

Braun et al U.S. Pat. No. 4,453,507 issued Jun. 12, 1984 and assigned to Briggs and Stratton Corporation, the assignee of the present invention, discloses a compression release mechanism in which the load imposed by the valve operating means is spaced from the pivot pin. As disclosed in Column 3, Lines 52 transferred to the camshaft via a load bearing surface located at the base of the auxiliary cam member.

SUMMARY OF THE PRESENT INVENTION

An improved centrifugally responsive compression release mechanism is disclosed in which the load imposed by the valve operating means is borne by at least one shoulder means adjacent the outer surface of the camshaft, and by a surface located on a pin retainer that receives the pivot pin. This arrangement prevents the load from being imparted to the pivot pin, thereby allowing a plastic material to be used for both the pivot pin and the camshaft. The overall cost of the engine is reduced since a much less expensive plastic camshaft may be used in place of the conventional metal camshaft.

In a preferred embodiment, the improved compression release mechanism according to the present invention is used on an internal combustion engine having at least one combustion chamber, a valve means for controlling the flow of a gas to the combustion chamber, and a valve operating means for unseating and seating the valve means on its valve seat.

The present invention uses a camshaft having a unique design near the place where the compression release means is disposed on the camshaft. In a preferred embodiment, the camshaft has a first shoulder and an adjacent slot near the camshaft outer surface, a first pivot pin extending from the outer surface and disposed adjacent the first shoulder, a second shoulder and an adjacent slot near the camshaft outer surface and disposed opposite the first shoulder, and a second pivot pin extending from the outer surface adjacent to the second shoulder. The camshaft also has a recess adapted to receive a portion of the compression release member when the auxiliary cam member affixed to the release member is disengaged from the valve operating means.

The engine according to the preferred embodiment has a compression release means for releasing pressure in the engine combustion chamber at engine cranking speeds. The compression release means includes a compression release member that partially encircles a portion of the camshaft that is opposite a cam. The compression release member is pivotally connected to the camshaft by the first and second pivot pins. The compression release member is preferably a yoke that is generally U-shaped having first and second legs connected by a curved saddle.

The compression release means includes an auxiliary cam member attached to the saddle and adapted to engage the valve operating means to unseat the valve means at engine cranking speeds.

The preferred embodiment also includes a centrifugally responsive weight means, consisting of a pair of flyweights, for pivoting the compression release member about the first and second pivot pins at engine running speed to disengage the auxiliary cam member from the valve operating means. At engine cranking speed, the weight of the flyweights pivots the compression release member such that the auxiliary cam member engages the cam follower of the valve operating means to unseat the valve means.

A key feature and advantage of the present invention is the manner in which loads imposed by the valve operating means are transmitted to the camshaft. When the auxiliary cam member engages the cam follower, a portion of the load is borne by the first camshaft shoulder as well as by a first surface on the compression release member that abuts the first camshaft shoulder. At the same time, a portion of the load is also borne by the second camshaft shoulder, and by a second surface on the compression release member that abuts the second camshaft shoulder. The first surface on the compression release member is preferably located on the pin retainer which retains the pivot pin in the compression release member. Similarly, the second surface is preferably located on the second pin retainer which retains the second pivot pin therein.

The compression release member according to the present invention has a unique design in which the longitudinal axes of the respective centrifugally responsive flyweights are parallel to the longitudinal axis of the camshaft when the auxiliary cam member is in its engaged position. In that engaged position, the flyweights are positioned in apertures in the cam gear. When the auxiliary cam member is in the disengaged position, the auxiliary cam member and a portion of the compression release member are received in a camshaft recess so that they do not interfere with the normal operation of the valve operating means.

It is a feature and advantage of the present invention to provide an improved centrifugally responsive compression release mechanism in which loads are borne by the camshaft at surfaces spaced from both the auxiliary cam member and the pivot pins.

It is another feature and advantage of the present invention to reduce the overall cost of an engine by permitting an inexpensive camshaft to be used in place of the typical metal camshafts.

It is yet another feature and advantage of the present invention to extend the life of compression release mechanisms by reducing the wear and the breaking-off incidence of the pivot pins that retain the compression release mechanism.

It is yet another feature and advantage of the present invention to provide a flexible compression release mechanism that is easy to assemble since it is snapped into place, and does not require an additional spring or a separate pivot pin.

These and other features of the present invention will be apparent to those skilled in the art from the following detailed description of preferred embodiments and the following drawings, in which:

DETAILED DESCRIPTION OF PREFERRED EMBODIMENTS

Figure 1:
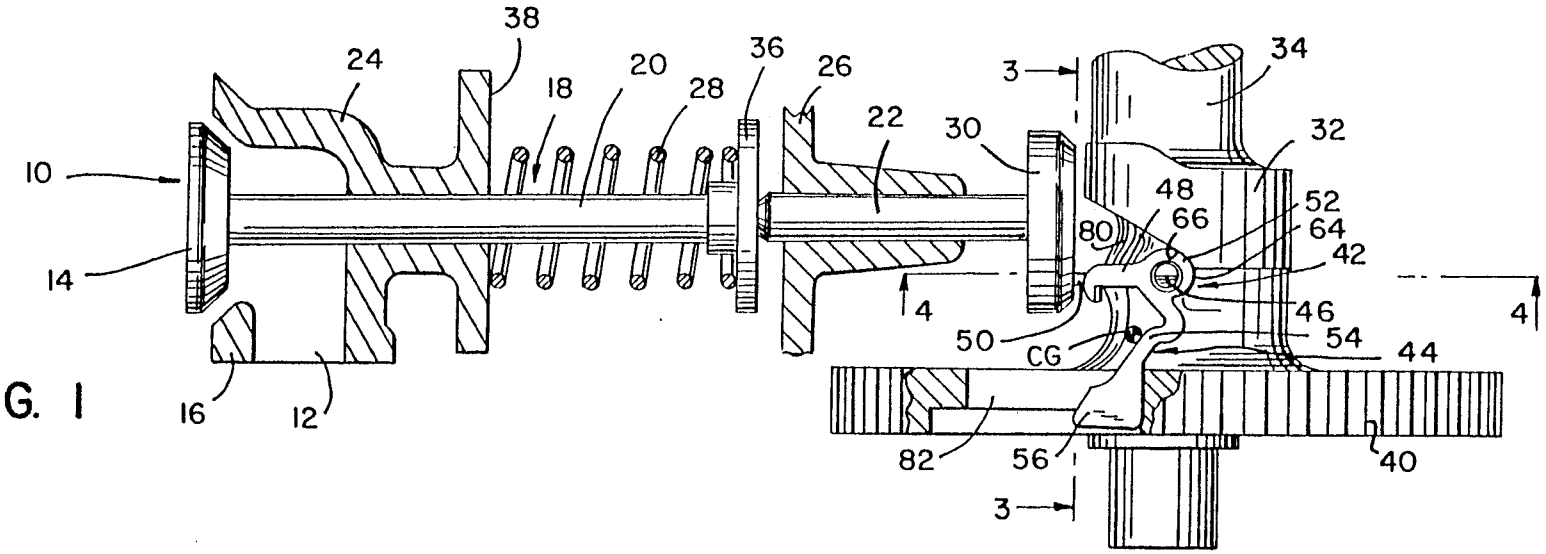
FIG. 1 is a side view of the compression release means according to the present invention in its engaged position at engine cranking speed.
Figure 2:
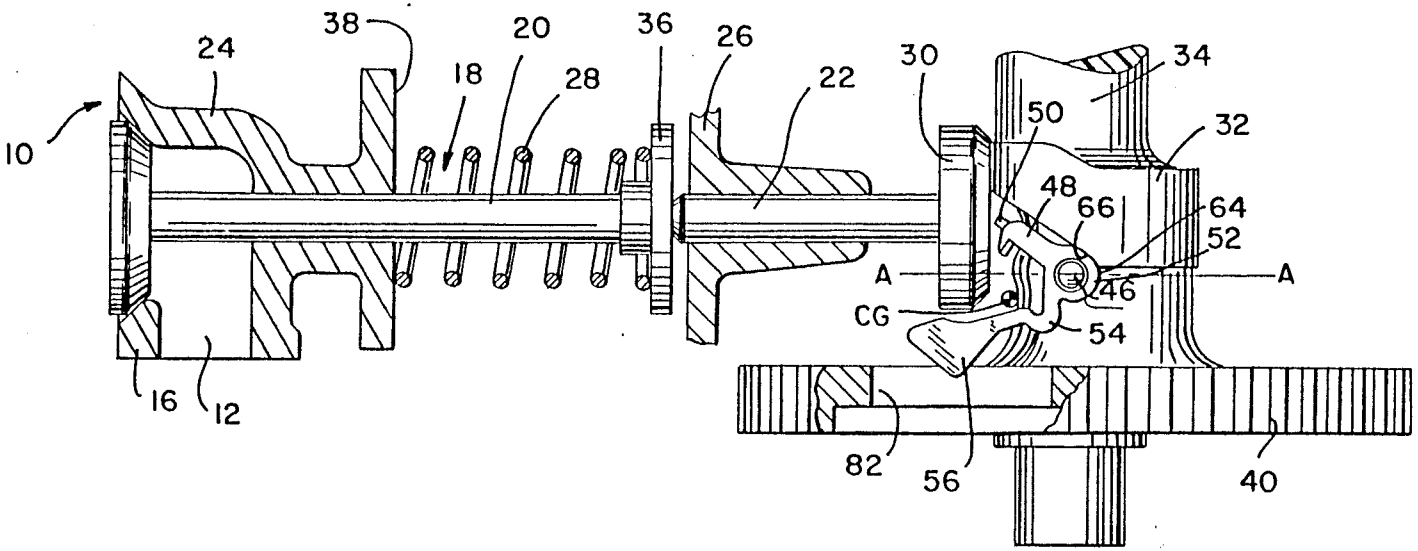
FIG. 2 is a side view of the compression release means in its disengaged position at engine running speeds.

As shown in FIGS. 1 and 2, a valve means 10 controls the flow of gas between a port 12 and a combustion chamber of the engine. Valve means 10 may be either an exhaust valve or an intake valve. The combustion chamber is not specifically illustrated in the figures, but is generally to the left of valve 10 in FIGS. 1 and 2. Valve 10 is of the usual poppet type having a head 14 that is alternately seated and unseated on a seat 16. The valve is closed when valve head 14 is seated on seat 16, thereby closing the conduit between the combustion chamber and port 12. The valve has an axially movable structure 18 that enables the valve to alternate between its closed position and its open position Structure 18 includes a valve stem 20 connected to valve head 14, and a coaxial tappet 22 separated from stem 20. Valve stem 20 is confined to axial movement in a valve guide 24 typically casted into the engine body, while tappet 22 is also mounted in a coaxial tappet guide 26 formed integral with the engine body.

Valve means 10 is operated by a valve operating means that includes a spring 28, tappet 22 and a cam follower 30. Cam follower 30 is alternately engaged and disengaged by a cam 32 disposed on a camshaft 34, and by a compression release means discussed below.

Valve spring 28 surrounds valve stem 20 and is retained in place by a spring retainer 36 and by a surface 38 on valve guide 24. The spring force of spring 28 biases valve means 10 to its seated or closed position. The spring force of spring 28 is opposed by the axial movement of tappet 22 and cam follower 30 that move valve means 10 to its unseated or open position.

A cam gear 40 affixed to camshaft 34 is rotated by a timing gear (not shown) interconnected with the engine crankshaft (not shown). The timing gear and cam gear are designed such that camshaft 34 rotates at half the speed of the engine crankshaft.

Compression is released in the engine combustion chamber by an improved compression release means 42. The compression release means is centrifugally responsive so that it releases combustion chamber pressure only at relatively low, engine cranking speeds of about 700 rpm or less. At higher engine running speeds, the compression release means is disengaged from the valve operating means, enabling the valve bias means including spring 28 to keep valve means 10 closed until cam follower 30 engages cam 32.

Figure 4:
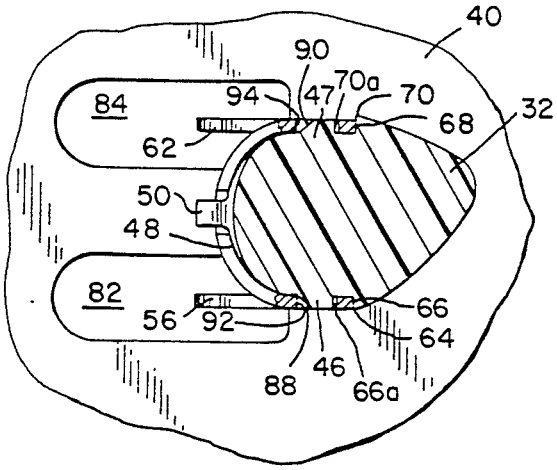
FIG. 4 is a top view of the compression release member in its engaged position, taken along line 4—4 of FIG. 1.

Compression release means 42 includes a compression release member 44 that partially surrounds camshaft 34 and that is pivotally connected to camshaft 34 by a pair of pivot pins 46 and 47 (FIG. 4). Release member 44 is preferably made from a flexible, resilient metal or other material that may be expanded to snap over the pivot pins and thereafter contract back to its original shape. The use of a flexible, resilient material eliminates the need for a separate pivot pin that is inserted into the camshaft during assembly, thereby decreasing cost.

Figure 6:
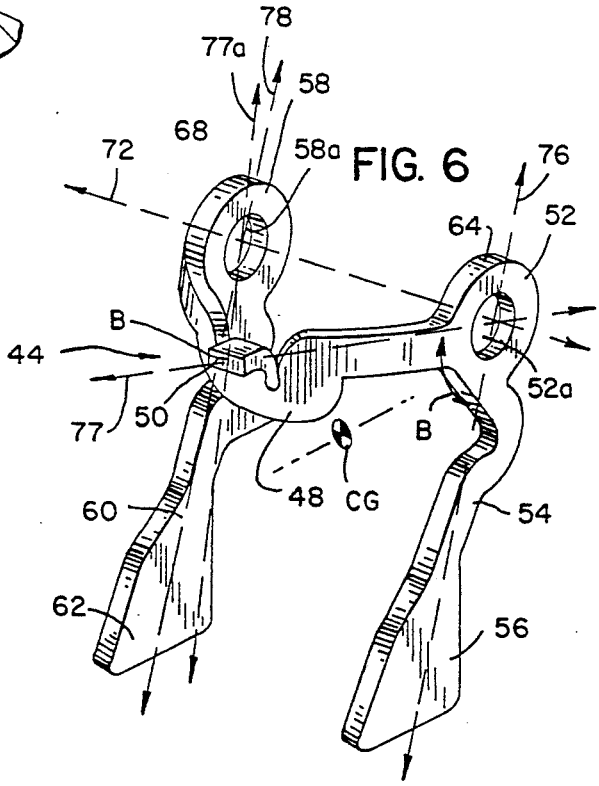
FIG. 6 is perspective view of the compression release member according to the present invention.

The shape of compression release member 44 is best depicted in FIG. 6. In all of the Figures, components having corresponding functions have been given the same numerical designations. Referring to FIG. 6, compression release member 44 consists of a yoke having a curved saddle 48 attached to which is an auxiliary cam member 50. Cam member 50 preferably lies in the same plane as pivot pins 46 and 48, plane A—A in FIG. 2, when the compression release member is in its engaged position. Plane A—A is parallel to cam gear 40. Cam member 50 may also lie below plane A—A in its engaged position. Auxiliary cam member 50 moves away from the cam follower during the transitional engine revolutions between the engaged and the disengaged position of the release member. If cam member 50 moved toward the cam follower during the transitional engine speeds, as in Braun et al. U.S. Pat. No. 4,453,507, the cam member would repeatedly strike the cam follower, imposing additional forces on the compression release members. The advantage of the present design is a longer life for the compression release member.

To one end of saddle 48 is connected a first pivot pin retainer 52, a first leg 54, and a first flyweight 56. Attached to the other end of saddle 48 are a second pin retainer 58, a second leg 60, and a second flyweight 62.

Figure 5:
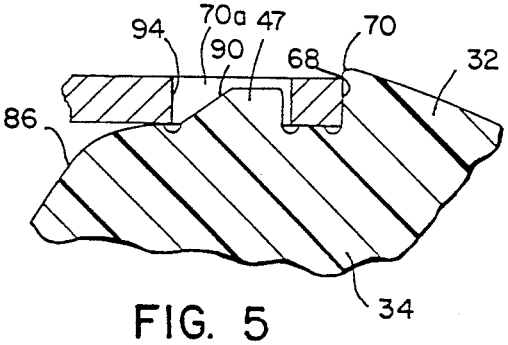
FIG. 5 is a cross sectional view of a pin and pin retainer assembly, depicting the load bearing surfaces.

First pin retainer 52 has a first load bearing surface 64 thereon which abuts a first shoulder 66 (FIGS. 1 through 5) on camshaft 34. Similarly, a second pin retainer 58 has a second surface 68 thereon which abuts a second shoulder 70 (FIGS. 4 and 5) on camshaft 34.

Figure 3:
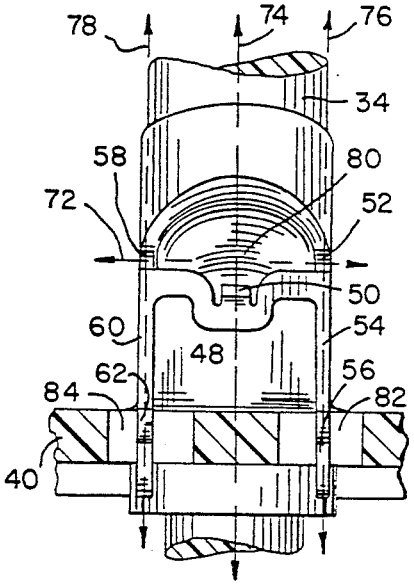
FIG. 3 is a frontal view of the compression release member in its engaged position, taken along line 3—3 of FIG. 1.

As best shown in FIGS. 3, 4 and 6, the compression release member according to the present invention has a unique design in which a line 72 joining pin retainers 52 and 58 intersects the line through flyweight 56 in the flyweight's longitudinal direction at an angle of less than or equal to about 90 degrees. Similarly, line 72 intersects a line 78 through the second flyweight 62 in its longitudinal direction at an angle of less than or equal to about 90 degrees. See FIGS. 3 and 6. Line 72 is also substantially normal to line 74, which represents the longitudinal axis of camshaft 34. Thus, as best shown in FIG. 3, weights 56 and 62 are substantially parallel to each other and are parallel to longitudinal axis 74 of camshaft 34. In short, the compression release member has a curved saddle with two opposite, downwardly-extending legs and flyweights.

As more fully discussed below, the unique design of compression release member 44 enables the compression release member to be moved out of the way into a recess 80 in camshaft 34 when the compression release means is disengaged at engine running speeds. See FIG. 2. In FIG. 6, the angle B between axis 76 and line 77 is less than or equal to about 90 degrees. Angle B may also be defined as the angle between axis 76 and line 77*a* where, as in FIG. 6, auxiliary cam member 50 is affixed at the center of saddle 48. This configuration allows legs 54 and 60 and their respective flyweights to clear cam follower 30 when the release member is in its disengaged position. Lines 77 and 77*a* are defined as the lines between the centers of their respective pin retainers 52*a* and 58*a* and the upper surface 50*a* of auxiliary cam member 50.

The compression release member is designed so that the effect of gravity on the flyweights biases the compression release member to its engaged position.

The compression release member is also designed so that its center of gravity CG lies in the region between flyweight legs 54 and 60 and below saddle 48. The position of center of gravity CG is best shown in FIGS. 3 and 6. This positioning of the center of gravity is important for the optimal operation of the compression release means, as discussed below. Also, the position of the center of gravity at a point that is distant from the pivot pins results in higher torques about pivot axis 72 due to gravitational forces than in prior art compression release mechanisms like the one disclosed in Braun et al U.S. Pat. No. 4,453,507.

As shown in FIGS. 1, 3 and 4, flyweights 56 and 62 are retained in apertures 82 and 84 in cam gear 40 when the compression release means is in its engaged position. At that time, the rotational speed of camshaft 34 is insufficient to result in sufficient centrifugal force to overcome the weight of flyweights 56 and 62. More specifically, the torque about pivot axis 72 resulting from the centrifugal force acting on center of gravity CG is less than the torque produced by the combined weight of the flyweights and the yoke. The flyweights thus remain near the outer surface of the camshaft, causing the auxiliary cam member to engage cam follower 30 and unseat valve means 10.

At higher engine running speeds, the torque about pivot axis 72 resulting from the centrifugal force exceeds the torque produced by the combined weight of the flyweights and the yoke causing the flyweights to move radially outwardly from camshaft 34, thereby pivoting compression release member 44 on pivot pins 46 and 47. See FIG. 2. This pivoting causes auxiliary cam member 50 to disengage cam follower 30 by moving it away from cam follower 30, thereby allowing the valve biasing means including spring 28 to bias the valve to its normally seated position. As depicted in FIG. 2, flyweights 56 and 62 move out of apertures 82 and 84 respectively at engine running speeds.

No biasing spring is required if the compression release member is used on a vertical shaft engine. For horizontal shaft engines, a biasing spring may be needed to bias the compression release member to its engaged position. The spring may be eliminated for vertical shaft engines because most of the release member's mass is located to one side (i.e. to the left in FIGS. 1 and 2) of the pivot pins. This design produces a desirable, higher engagement torque about pivot axis 72 and the selected disengagement speed without a spring. The elimination of the spring lowers the costs of the compression release means, and also increases both its reliability and its simplicity. The release member may have a different mass distribution if a spring is used.

A key feature of the present invention is that loads imposed by the valve operating means and the valve means are imparted onto camshaft 30 at a point that is spaced from the pivot pins as well as spaced from auxiliary cam member 50. These loads are transmitted to the camshaft via a first surface 64 on pin retainer 52 and a corresponding shoulder 66 on camshaft 34. Similarly, a portion of the load is transmitted to the camshaft via a second surface 68 located on second pin retainer 58 and a corresponding shoulder 70 located near the outer surface 86 of camshaft 34. To insure that these loads are in fact transmitted to the camshaft and are not borne by pins 46 and 48, the pins are designed having generally cylindrical shapes (FIGS. 4 and 5) truncated with angled planes 88 and 90, respectively. This shape prevents the inner surfaces 92 and 94 of pin retainers 52 and 58 respectively from imparting undue loads onto the pins and from thereby breaking off their respective pins 46 and 48. The angled leading surfaces 88 and 90 also facilitate assembly of the yoke to the camshaft.

To also insure that the loads are borne by surface 64 and its corresponding shoulder 66, pin retainer 52, its aperture 52*a*, pin 46 and slot 66*a* are sized such that surface 64 contacts shoulder 66 before surface 92 contacts surface 88. Similarly, pin retainer 58, its aperture 58*a*, pin 47 and slot 70*a* are sized such that surface 68 contacts shoulder 70 before surface 94 contacts surface 90.

Shoulders 66 and 70 are preferably surfaces formed adjacent to slots 66*a* and 70*a* respectively. The slots and the shoulders are near the outer surface of the camshaft. The slots are designed to receive their respective pin retainers. The shoulders may alternatively be comprised of tabs extending from the camshaft outer surface.

Another key feature of the present invention is its relative compactness. This compactness is achieved by positioning the compression release means on the point of the camshaft that is substantially opposite to cam 32. The unique design of the compression release member described above permits this compact design to be achieved.

The placement of the load bearing surfaces adjacent to the outer surface of the camshaft as described herein enables a molded, plastic camshaft to be used in place of the much heavier and more expensive iron camshafts in typical prior art engines. One suitable camshaft according to the present invention may be made from a phenolic-based composite plastics material, although a variety of other plastics materials may be used.

Although a preferred embodiment of the present invention has been shown and described, alternate embodiments will be apparent to those skilled in the art and are within the contemplated scope of the present invention. Therefore, the invention is to be limited only by the following claims.

I claim:

1. An internal combustion engine having a combustion chamber, comprising:

valve means for controlling the flow of a gas to said combustion chamber, said valve means including a valve seat;

valve operating means for unseating said valve means from said valve seat;

a camshaft having an outer surface and also including:

at least one pivot pin extending from the outer surface of said camshaft;

at least one shoulder means near said pivot pin for bearing load forces of said valve operating means;

a cam disposed on said camshaft that engages said valve operating means to unseat said valve means;

a compression release means for releasing compression in said combustion chamber at engine cranking speeds, comprising:

a compression release member that partially surrounds said camshaft and that is pivotally connected to said camshaft by said pivot pin;

an auxiliary cam member affixed to said compression release member that engages said valve operating means to unseat said valve means at engine cranking speeds;

a first surface on said compression release member that abuts said shoulder means when said auxiliary cam member engages said valve operating means to transfer loads from said auxiliary cam member to said shoulder means; and weight means, responsive to centrifugal force, for pivoting said compression release member about said pivot pin at engine running speeds to disengage said auxiliary cam member from said valve operating means.

2. The engine of claim 1, comprising:

a cam gear disposed on said camshaft that receives said weight means when said cam member disengages said valve operating means.

3. The engine of claim 2, wherein said auxiliary cam member is located in a plane that passes through said pivot pin and that is parallel to said cam gear when said auxiliary cam member is engaging said valve operating means.

4. The engine of claims 1, wherein the mass of said compression release member is substantially located on one side of said pivot pin.

5. The engine of claim 1, wherein said compression release member includes a yoke having first and second legs connected by a saddle, and wherein the auxiliary cam member is disposed on the saddle.

6. The engine of claim 5, wherein said weight means includes:

a first flyweight interconnected with said first leg; and a second flyweight interconnected with said second leg.

7. The engine of claim 5, wherein the center of gravity of said compression release member lies between said first leg, said second leg, and said saddle.

8. The engine of claim 1, wherein said first surface is on a pin retainer means for receiving said pivot pin.

9. The engine of claim 1, wherein said valve operating means includes:

a cam follower that alternately engages said cam and said auxiliary cam member at engine cranking speeds to unseat said valve means.

10. The engine of claim 1, further comprising a slot formed in the outer surface of said camshaft adjacent to said shoulder means.

11. The engine of claim 1, wherein said pivot pin is substantially shaped like a cylinder truncated by a plane.

12. The engine of claim 1, wherein said shoulder means is adjacent to said cam.

13. The engine of claim 1, wherein said shoulder means includes a load bearing surface formed adjacent to said camshaft outer surface.

14. The engine of claim 1, wherein said compression release member is disposed about said camshaft at a location opposite to said cam.

15. The engine of claim 1, wherein said camshaft includes a recess adapted to receive said auxiliary cam member when said auxiliary cam member is disengaged from said valve operating means.

16. The engine of claim 15, wherein said camshaft recess is also adapted to receive a portion of said compression release member.

17. The engine of claim 1, wherein said weight means includes a flyweight, and further comprising:

a longitudinal axis in said flyweight;

a pin retainer means for receiving said pivot pin; and a first line between said pin retainer means and said auxiliary cam member;

wherein the angle between said longitudinal axis and said first line is less than or equal to about 90 degrees.

18. The engine of claim 1, wherein said compression release member is made from a flexible, resilient material.

19. An internal combustion engine having a combustion chamber, comprising:

valve means for controlling the flow of a gas to said combustion chamber, said valve means including a valve seat;

valve operating means for unseating said valve from said valve seat;

a camshaft having an outer surface and also including:

a first load bearing means interconnected with said camshaft for receiving load forces of said valve operating means;

a first pivot pin extending from said outer surface;

a second load bearing means interconnected with said camshaft for receiving load forces of said valve operating means;

a second pivot pin extending from said outer surface;

a cam disposed on said camshaft that engages said valve operating means to unseat said valve means;

a compression release means for releasing pressure in said combustion chamber at engine cranking speeds, comprising:

a compression release member that partially encircles said camshaft and that is pivotally connected to said camshaft by said pivot pins;

an auxiliary cam member affixed to said compression release member that engages said valve operating means to unseat said valve means at engine cranking speeds;

a first surface on said compression release member that abuts said first load bearing means when said auxiliary cam member engages said valve operating means to transfer load forces to said first load bearing means;

a second surface on said compression release member that abuts said second load bearing means when said auxiliary cam member engages said valve operating means to transfer load forces to said second load bearing means; and centrifugally responsive means for rotating said compression release member about said first and second pivot pins at engine running speed to disengage said auxiliary cam member from said valve operating means.

20. The engine of claim 19, wherein said compression release means includes:

a curved saddle having opposed first and second legs and the auxiliary cam member therebetween;

a first flyweight interconnected with said first leg;

a first pivot pin retainer adjacent said first leg that receives said first pivot pin and that has said first surface thereon;

a second flyweight interconnected with said second leg; and a second pivot pin retainer adjacent said second leg that receives said second pivot pin and that has said second surface thereon.

21. The engine of claim 19, wherein said first and second shoulders are disposed opposite each other near said outer surface, and further comprising:

a first slot formed in said camshaft outer surface adjacent to said first shoulder; and a second slot formed in said camshaft outer surface adjacent to said second shoulder.

22. The engine of claim 19, wherein said first pivot pin and said second pivot pin are disposed opposite each other on said camshaft.

23. The engine of claim 19, wherein said centrifugally responsive means includes a pair of opposed flyweights interconnected with said compression release member.

24. The engine of claim 20, wherein said camshaft includes a recess adapted to receive a portion of said saddle when said auxiliary cam member is disengaged from said valve operating means.

25. The engine of claim 19, wherein the mass of said compression release member is substantially located on one side of said first pivot pin and said second pivot pin.

26. The engine of claim 20, wherein the center of gravity of said compression release member lies between said first leg, said second leg, and said saddle.

27. The engine of claim 20, further comprising:

a longitudinal axis in said first flyweight;

a pin retainer means for receiving said first pivot pin; and a first line between said pin retainer means and said auxiliary cam member;

wherein the angle between said longitudinal axis and said first line is less than or equal to about 90 degrees.

28. The engine of claim 19, wherein said compression release member is made from a flexible, resilient material.

29. A compression release member that pivots on at least one camshaft pin and that engages a valve operating means to release pressure in an engine combustion chamber, comprising:

a curved saddle having a first end and a second end;

a first leg interconnected with first end of said saddle;

a first flyweight interconnected with said first leg, said first flyweight having a first longitudinal axis;

a second leg, opposite said first leg, interconnected with the second end of said saddle;

a second flyweight interconnected with said second leg;

an auxiliary cam member affixed to said saddle; and a pin retainer means interconnected with said saddle for receiving said pivot pin, said pin retainer means and said auxiliary cam member defining a first line;

wherein the mass of said compression release member is substantially located on one side of said pivot pin; and wherein the angle between said first longitudinal axis and said first line is less than or equal to about 90 degrees.

30. The compression release member of claim 29, wherein said second flyweight has a second longitudinal axis, and wherein the angle between said second longitudinal axis and said first line is less than or equal to about 90 degrees.

31. A compression release member that pivots on at least one cam shaft pivot pin and that engages a valve operating means to release pressure in an engine combustion chamber, said compression release member having a center of gravity, said release member comprising:

a curved saddle having a first end and a second end;

a first leg interconnected with first end of said saddle;

a first flyweight interconnected with said first leg, said first flyweight having a first longitudinal axis;

a second leg, opposite said first leg, interconnected with the second end of said saddle;

a second flyweight interconnected with said second leg;

an auxiliary cam member affixed to said saddle; and a pin retainer means interconnected with said saddle for receiving said pivot pin, said pin retainer means and said auxiliary cam member defining a first line;

wherein the center of gravity of said compression release member is located on the same side of said pivot pin as said auxiliary cam member; and wherein the angle between said first longitudinal axis and said first line is less than or equal to about 90 degrees.

32. An internal combustion engine having a combustion chamber, comprising:

valve means for controlling the flow of a gas to said combustion chamber, said valve means including a valve seat;

valve operating means for unseating said valve means from said valve seat;

a cam shaft having an outer surface and a longitudinal camshaft axis, said cam shaft also including:

a first pivot pin extending from said outer surface;

a second pivot pin extending from said outer surface, said first pivot pin and said second pivot pin defining a pivot axis, said pivot axis and said cam shaft axis defining a plane;

a compression release means for releasing compression in said combustion chamber at engine cranking speeds, comprising:

a compression release member that is pivotally connected to said cam shaft by said pivot pins;

an auxiliary cam member affixed to said compression release member that engages said valve operating means to unseat said valve means at engine cranking speeds, said cam member laying on a first side of said plane; and weight means, responsive to centrifugal force, for pivoting said compression release member about said pivot axis at engine running speeds to disengage said auxiliary cam member from said valve operating means;

wherein said compression release means has a center of gravity that also lies on the first side of said plane.

* * * * *

UNITED STATES PATENT AND TRADEMARK OFFICE

CERTIFICATE OF CORRECTION

PATENT NO. : 5,150,674

DATED : September 29, 1992

INVENTOR(S) : Gracyalny

It is certified that error appears in the above-identified patent and that said Letters Patent is hereby corrected as shown below:

IN THE CLAIMS:

| | |
|---|---|
| CLAIM 4<br>Col. 7 Line 1<br>(Claim 4<br>Application: 5/21/91) | after "of" delete "claims" and substitute therefor ---claim--- |

Signed and Sealed this

Nineteenth Day of April, 1994

*Attest:*

*Attesting Officer*

Bruce Lehman

BRUCE LEHMAN

*Commissioner of Patents and Trademarks*